United States Patent [19]

Chen

[11] Patent Number: 4,866,451

[45] Date of Patent: Sep. 12, 1989

[54] BROADBAND CIRCULAR POLARIZATION ARRANGEMENT FOR MICROSTRIP ARRAY ANTENNA

[75] Inventor: Chun-Hong H. Chen, Andover, Mass.

[73] Assignee: Communications Satellite Corporation, Washington, D.C.

[21] Appl. No.: 623,877

[22] Filed: Jun. 25, 1984

[51] Int. Cl.[4] ..... H01Q 00/00

[52] U.S. Cl. ..... 343/700 MS

[58] Field of Search ..... 343/700 MS, 829, 830

[56] References Cited

U.S. PATENT DOCUMENTS

| | | | |
|---|---|---|---|
| 3,921,177 | 11/1975 | Munson | 343/700 MS |
| 4,477,813 | 10/1984 | Weiss | 343/700 MS |
| 4,543,579 | 9/1985 | Teshirogi | 343/700 MS |
| 4,554,549 | 11/1985 | Fassett et al. | 343/700 MS |

*Primary Examiner*—William L. Sikes
*Assistant Examiner*—Robert E. Wise
*Attorney, Agent, or Firm*—Sughrue, Mion, Zinn, Macpeak & Seas

[57] ABSTRACT

The invention relates to a circular polarization (CP) technique and a microstrip array antenna implementing this technique. Using four microstrip radiating elements with proper phasing of the excitation in a 2×2 array configuration, the technique averages out the cross-polarized component of the radiation, generating circular polarization of high purity. The technique is broadband and capable of dual-polarized operation. The resultant 2×2 array can be used either independently as a CP radiator or as the building subarray for a larger array.

13 Claims, 4 Drawing Sheets

BROADBAND CIRCULAR POLARIZATION ARRANGEMENT FOR MICROSTRIP ARRAY ANTENNA

BACKGROUND OF THE INVENTION

In a modern satellite communications system utilizing frequency reuse, the antenna system is required to be circularly polarized with a high polarization purity oer a broad band-width and, at the same time, must be capable of dual-polarized operation. Microstrip antennas have recently been enjoying growing popularity in various applications due to their inherent features such as low profile, light weight, and small volume. The natural radiation is, however, linearly polarized, and thus the circular polarization technique is needed when the microstrip antenna is to be used in satellite communications.

Circular polarization is achieved by combining two orthogonal linearly polarized waves radiating in phase quadrature. There are currently two commonly used techniques for resonant microstrip radiators: the single feed technique, where asymmetry is introduced into the geometry of the microstrip radiator so that, when excited at a proper point, the antenna radiates two degenerated orthogonal modes with a 90° phase difference; and the dual feed technique, where two separate and spatially orthogonal feeds are excited with a relative phase shift of 90°. For more specific discusson of these techniques, the reader is referred to K. R. Carver and J. W. Mink, "Microstrip Antenna Technology", *IEEE Trans. on Antennas and Propagation,* Vol. AP-29,. No. 1, January 1981, pp. 1–24. The single feed aproach has the advantage of a simple feed circuit, but suffers from a very narrow useful bandwidth. Examples of the single feed approach include the corner-fed rectangle, the elliptical patch, the square patch with a 45° center slot, the pentagon-shaped patch, and the circular patch with notches or teeth. Such techniques are discussed, for example in M. Hanesishi and S. Yoshida, "A Design of Back-Feed Type Circularly-Polarized Microstrip Dish Antenna Having Symmetrical Perturbation Element by One-Point Feed", *Electronics and Communications in Japan,* Vol. 64-B, No. 7, 1981, pp. 52–60.

The dual feed approach requires the use of a 90° hybrid or power splitter with unequal lengths of transmission line to provide the necessary phase shift. The usable bandwidth can be very wide if both the microstrip radiator and the feeding network are broadband devices. The technique, however, suffers from poor polarization purity due to the cross-polarized components generated by the asymmetrical feed structure. One method of cancelling the cross-polarized component is to excite the two feeds unequally, as discussed in H. Chen, "STC Microstrip Plannar Array Development", COMSAT Technical Note, 831564/K82, Feb. 15th, 1984. This method will improve one sense of circular polarization at the expense of degrading the other sense of polarization, and, thus, is incapable of dual-polarized operation. The Chen article, which is not prior art as respects the invention, is hereby expressly incorporated by reference herein.

The cross-polarized component can also be eliminated by cutting two notches on the microstrip radiator to compensate for the feed asymmetry as discussed in T. Teshirogi, "Recent Phased Array Work in Japan", ESA/COST 204 Phase-Array Antenna Workshop, Noorwijh, the Netherlands, June 13th, 1983, pp. 37–44.

Capable of dual-polarized operation, this approach is, however, empirical and leads to noticeable changes in antenna characteristics such as resonant frequncy, complicating the antenna design procedure.

SUMMARY OF THE INVENTION

The invention relates to a broadband circular polarization technique and an array antenna which implements this technique. The circular polarization technique of the invention is also a dual-feed technique. However, unlike the abovementioned dual feed techniques, in which the effort at eliminating the cross-polarized component is made on the radiator itselt, the invention compensates for feed asymmetry at the array level, since the microstrip radiator will eventually be used in an array. The invention, in addition to achieving broadband and dual-polarized capability, generates circularly-polarized radiation of an excellant axial ratio because of its inherent averaging effect.

DETAILED DESCRIPTION OF THE PREFERRED EMBODIMENT

Figure 1:
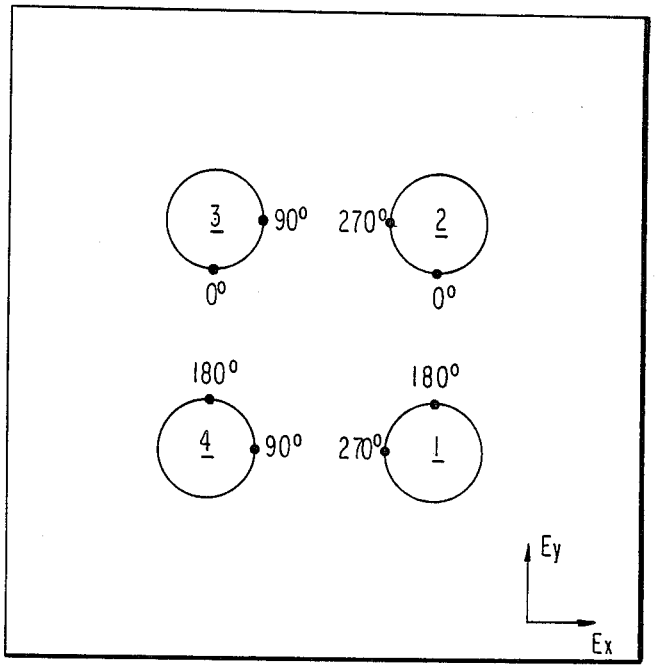
FIG. 1 schematically illustrates one embodiment of the present invention.

FIG. 1 illustrates one embodiment of the present invention. Four CP microstrip patch elements 1, 2, 3 and 4 form a CP 2×2 array in which the radiating elements' feed points are symmetrically located with respect to the array center. To obtain in-phase circularly-polarized radiation from the individual elements, the array is equally excited at each feeding point with the phase shown in FIG. 1.

Experiments have shown that the radiation from the dual-fed CP microstrip radiator is elliptically polarized in such a way that, among the two orthogonal linearly polarized components, $E_x$ and $E_y$, the phase-lagging component is always weaker in strength than the phase-leading component. While $E_x$ generated by elements 1 and 3 in FIG. 1 is stronger than $E_y$, the difference is balanced by radiation from elements 2 and 4, which radiate stronger $E_y$ than $E_x$. The averaging effect thus leads to circular polarization of high purity.

The invention may be easily produced using electromagnetically-coupled patchs (EMCPs) as a broadband microstrip radiator.

Figure 3:
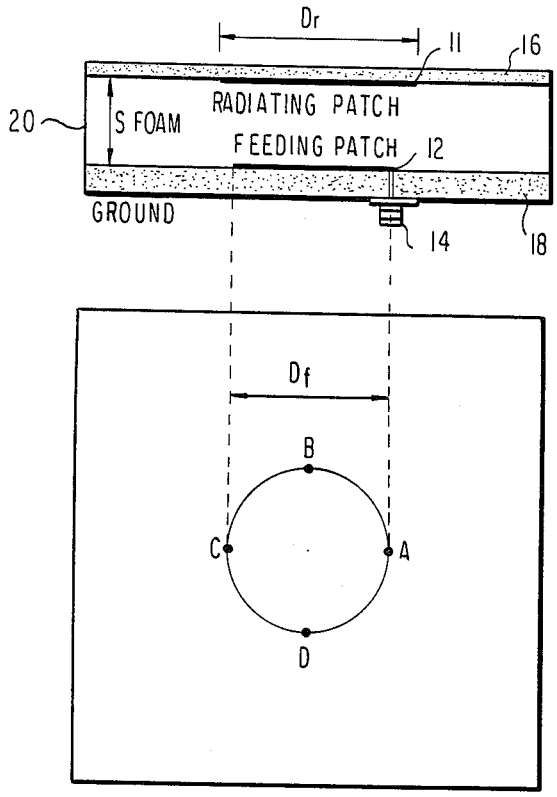
FIG. 3 illustrates the structure of one of plural EMCP's used in the array.

FIG. 3 illustrates the structure of the EMCPs used in the invention. The antenna element consists of two circular patches of diameters $D_f$ and $D_r$ separated by a distance S. The top patch 11 (the radiating patch) is excited by the bottom patch 12 (the feeding patch), which is, in turn, fed by a coaxial line 14 from underneath, or by a microstrip line in the same plane as the feeding patch. The coaxial probe feed method is preferrable because it allows more flexibility in the feed network layout and separates the design of the feed network from that of the array. Commercially available copper-clad laminates 16, 18 (3M Cu-clad 250 LX-0300-45) were used to fabricate both the radiating and feeding patches, thus fixing the spacing between the feed patch and the ground plane. The radiating patch is etched beneath the top substrate 16, which also serves as a protective cover for the antenna element. The space between the two patches 11, 12 is filled with foam material 20 to support the radiating patch and maintain the proper separation.

Figure 4:
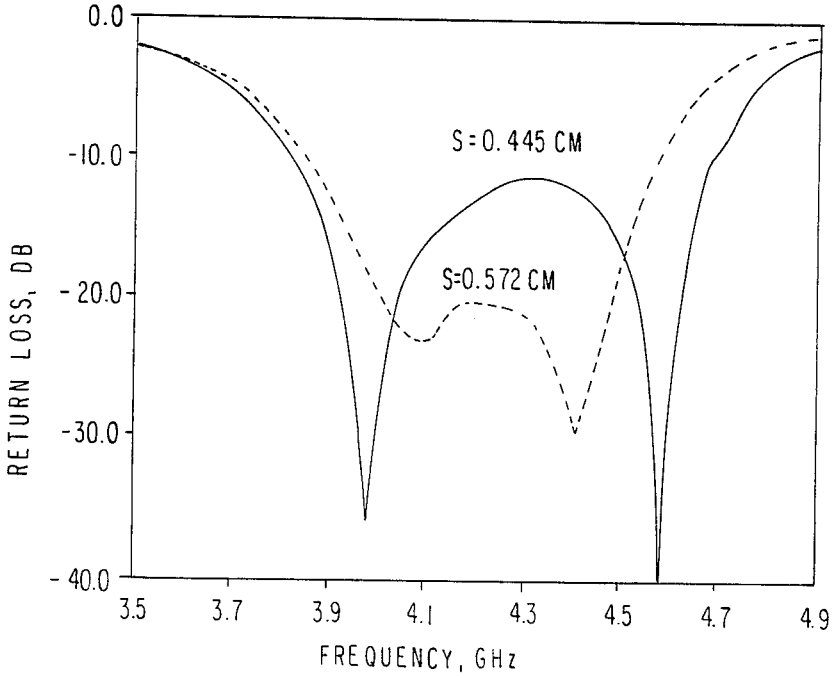
FIG. 4 shows the return loss of the EMCP in graphic form.
Figure 5:
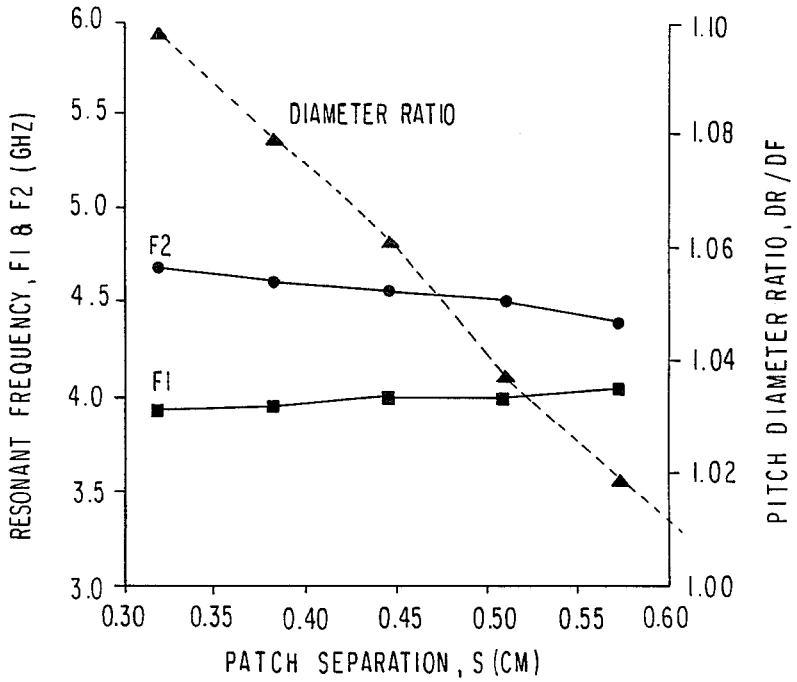
FIG. 5 illustrates the relationship of the patch diameters, resonant frequencies and the separation.

The return loss of the EMCP, as shown in FIG. 4, is characterized by two resonant frequencies which vary with separation. In general, the upper resonant frequency shifts downward and the lower shifts upward when the separation increases (FIGS. 4 and 5). The relatively constant lower resonant frequency is close to that predicted by the simple cavity model if the dimensions of the feeding patch are used in the calculations. A specific $D_f$ and separation S determine a particular $D_r$ that will generate double resonance. The ratio of $D_r$ and $D_f$ as a function of separation approaches unity with separation, as illustrated in FIG. 5.

Figure 6:
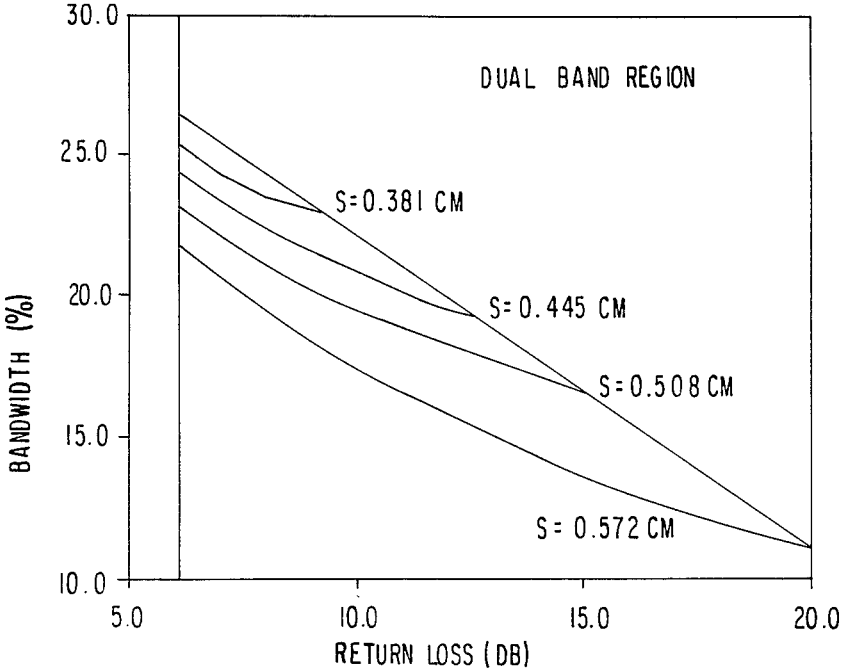
FIG. 6 illustrates the relationship between separation and bandwidth vs. return loss.

The achievable bandwidth of the EMCP depends on VSWR specifications. For a separation, S, of 0.572 cm, the operation band for 1.22:1 VSWR is 4.01–4.47 GHz (a 10.8 percent bandwidth) while the operation band for 1.92:1 VSWR is 3.85–4.58 GHz (a 17.3-percent bandwidth). However, for the relaxed 1.92:1 VSWR return loss requirement, the operation band can be expanded to achieve a 20.4 percent bandwidth (3.82–4.69 GHz) by reducing the separation to 0.445 cm. Bandwidth vs return loss for four different separations is given in FIG. 6.

The gan of an EMCP designed for 10-percent bandwidth (VSWR 1.2:1) was measured to be 7.9 dB at 4.25 GHz with a 3-dB beamwidth of approximately 90°. The EMCP has a generally wider bandwidth, broader beamwidth, smaller diameter (23-percent smaller), and lower cross-polarization level than a conventional patch fabricated on a thick, low dielectric substrate. Two features characteristic of the EMCP radiation pattern are a small gain variation within ±10° (less than 0.5 dB) and almost equal E- and H-plane patterns. The former helps minimize scan loss in a phased array, and the latter implies that the EMCP is a good CP radiator.

CP is obtained by exciting two orthogonal modes with equal amplitude and in-phase quadrature. However, when fed at two points (such as points A and B in FIG. 1), the EMCP generates highly elliptical polarization because of the asymmetrical feed structure. To obtain good CP, the asymmetry must be corrected or compensated for.

Figure 2:
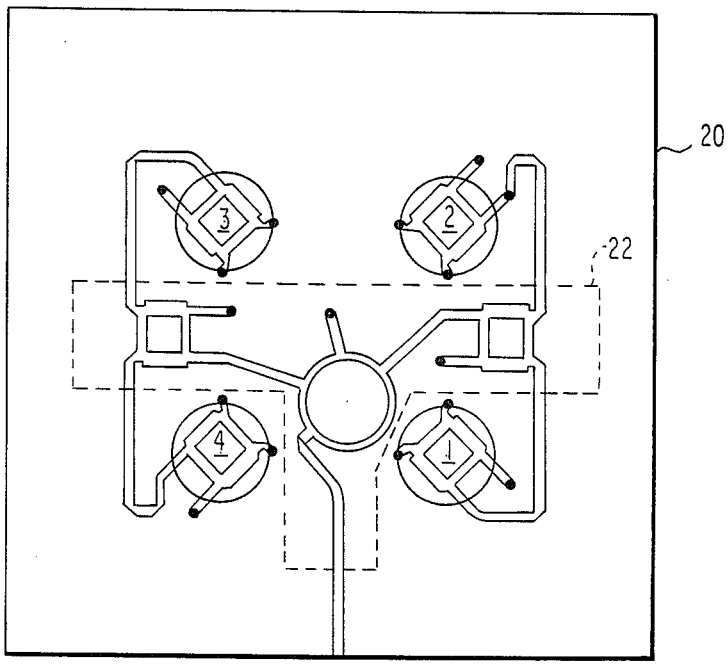
FIG. 2 is a schematic circuit diagram in stripline of a feeding network for the array.

FIG. 2 shows the circuit layout of the feeding network used in the invention. The network is fabricated in microstrip line on copper-clad teflon/glass laminate 21 (3M Cu-clad 250 LX-0300-45) and connected to the feeding patches of array elements 1–4 via coaxial feedthrough (such as at 14 in FIG. 3) for convenience in testing. The feeding network can be constructed in stripline right underneath the subarray and may share the common ground plane with the subarray. This will reduce feed line loss and avoid radiation from the unshielded line. For a dual-polarization application, another layer of stripline circuit can be constructed beneath the first layer stripline circuit. The second layer stripline, which would consist of a duplication of only that part of the circuit inside the dashed lines 22 in FIG. 2, provides a 4-way power split with 90° phase progression, and would be connected at its outputs to the second input ports of the four branch line hybrids beneath the feeding patches on the first layer stripline feeding network.

Figure 7:
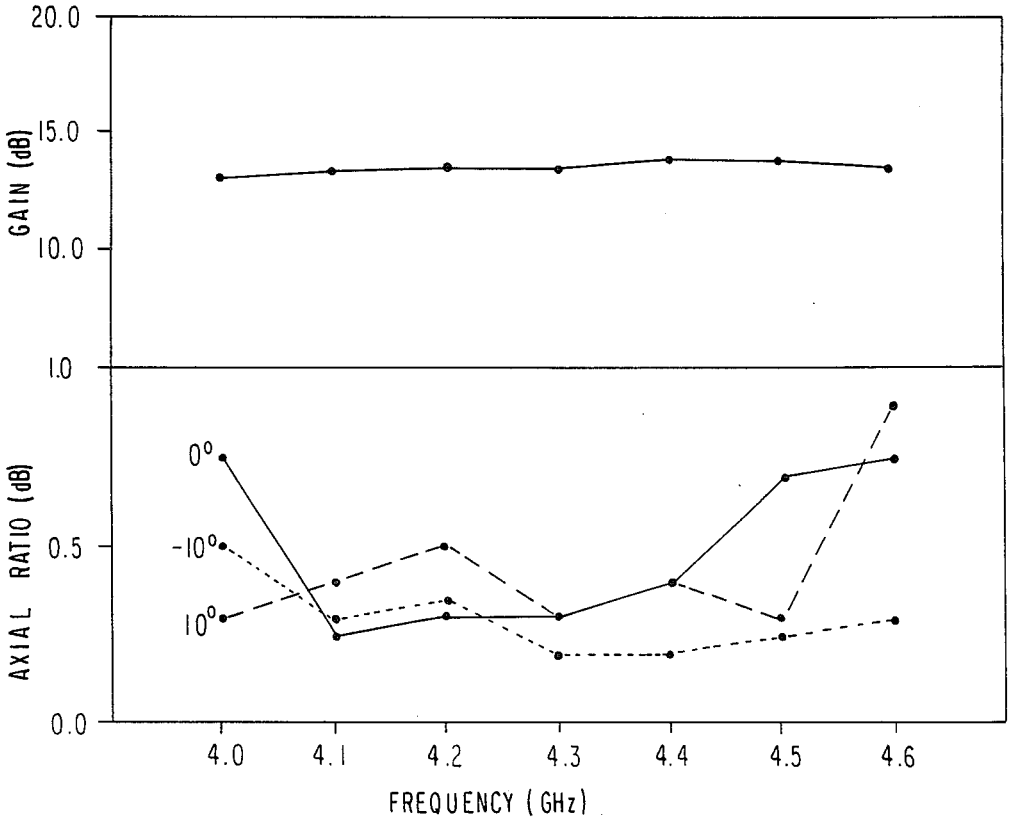
FIG. 7 illustrates test results of the device of FIG. 2.

Test results of the device of FIG. 2 are given in FIG. 7. The axial ratio is below 1.0 dB, and the gain is maintained constant in the frequency band of 4.0 to 4.6 GHz (a 14-percent bandwidth). Even the stringent requirement of 0.5-dB axial ratio can be achieved in the frequency band of 4.1 to 4.4 GHz (a 7 percent bandwidth).

I claim:

1. A microstrip array antenna, comprising: a symmetric array of electromagnetically coupled patch pairs, and a feeding network for said patch pairs, said feeding network being arranged such that each of said patch pairs are excited at plural feedpoints in phase quadrature.

2. An antenna as claimed in claim 1, wherein said array is equally excited at each said feed point.

3. An antenna as claimed in claim 1, wherein said feeding network is formed of stripline, or microstripline.

4. An antenna as claimed in claim 1, wherein each of said electromagnetically coupled patch pairs comprises a feeding patch, a radiating patch and a spacer of foam material arranged therebetween as a separator.

5. An antenna as claimed in claim 4, wherein said patches comprise a copper-clad laminate.

6. A circular polarization antenna, comprising: a symmetric array of individual antenna elements, and a feeding network for exciting each of said elements, wherein said elements each comprise a pair of electromagnetically coupled patches including a feeding patch connected to said feeding network, and a radiating patch spaced from said feeding patch.

7. An antenna as claimed in claim 6, wherein said feeding patches are arranged in a first plane, and wherein said radiating patches are formed in a second plane spaced from said first plane by a separation distance.

8. An antenna as claimed in claim 6, wherein said feeding network is at least partially constituted of a coaxial line.

9. An antenna as claimed in claim 8, wherein said feeding patches are connected to said feeding network via a coaxial construction.

10. An antenna as claimed in claim 6, wherein each of said elements includes a first substrate which is etched to produce said radiating patch.

11. An antenna as claimed in claim 6, wherein said feeding patches and said radiating patches are circular, and wherein the diameter of said radiating patches is greater than the diameter of said feeding patches.

12. A method of obtaining high purity broadband circular polarization, comprising;

providing a plurality of broadband microstrip resonators;

arranging said microstrip resonators in a symmetrical array; and exciting each of said resonators equally at each of plural feeding points so as to obtain averaging among phase lagging and phase leading radiation components.

13. A method as claimed in claim 12, wherein each of said resonators is formed of a pair of electromagnetically coupled spaced patches.

* * * * *